US010233555B2

(12) United States Patent
Aliprandini et al.

(10) Patent No.: US 10,233,555 B2
(45) Date of Patent: Mar. 19, 2019

(54) METHOD OF OBTAINING A YELLOW GOLD ALLOY DEPOSITION BY GALVANOPLASTY WITHOUT USING TOXIC METALS OR METALLOIDS

(75) Inventors: Giuseppe Aliprandini, Asnieres (CH); Michel Caillaud, Villers-le-Lac (FR)

(73) Assignees: THE SWATCH GROUP RESEARCH AND DEVELOPMENT LTD., Marin (CH); G. Aliprandini, Asnieres (CH)

( * ) Notice: Subject to any disclaimer, the term of this patent is extended or adjusted under 35 U.S.C. 154(b) by 1042 days.

(21) Appl. No.: 12/678,984

(22) PCT Filed: Sep. 11, 2008

(86) PCT No.: PCT/EP2008/062042

§ 371 (c)(1),
(2), (4) Date: Mar. 18, 2010

(87) PCT Pub. No.: WO2009/037180

PCT Pub. Date: Mar. 26, 2009

(65) Prior Publication Data

US 2010/0206739 A1 Aug. 19, 2010

(30) Foreign Application Priority Data

Sep. 21, 2007 (CH) ..... 1494/07

(51) Int. Cl.
*C25D 3/58* (2006.01)
*C25D 3/62* (2006.01)
*C25D 3/48* (2006.01)

(52) U.S. Cl.
CPC *C25D 3/62* (2013.01); *C25D 3/48* (2013.01)

(58) Field of Classification Search
CPC ..... C25D 3/56; C25D 3/58; C25D 3/62
USPC ..... 205/242, 249, 251, 247
See application file for complete search history.

(56) References Cited

U.S. PATENT DOCUMENTS

| | | | | | |
|---|---|---|---|---|---|
| 2,596,454 | A | * | 5/1952 | Williams | 420/587 |
| 2,660,554 | A | * | 11/1953 | Ostrow | 205/247 |
| 2,724,687 | A | | 11/1955 | Spreter et al. | |
| 2,976,180 | A | | 3/1961 | Brookshire | |
| 3,475,292 | A | * | 10/1969 | Shoushanian | 205/242 |
| 3,642,589 | A | * | 2/1972 | Nobel et al. | 205/242 |
| 3,666,640 | A | * | 5/1972 | Smith | 205/248 |
| 3,749,650 | A | * | 7/1973 | Dettke et al. | 205/247 |
| 3,878,066 | A | * | 4/1975 | Dettke et al. | 205/240 |
| 4,168,214 | A | | 9/1979 | Fletcher et al. | |
| 4,192,723 | A | * | 3/1980 | Laude et al. | 205/248 |
| 4,358,351 | A | * | 11/1982 | Simon et al. | 205/240 |
| 4,591,415 | A | * | 5/1986 | Whitlaw | 205/125 |
| 4,626,324 | A | | 12/1986 | Samuels et al. | |
| 4,687,557 | A | * | 8/1987 | Emmenegger | 205/50 |
| 4,980,035 | A | * | 12/1990 | Emmenegger | 205/238 |
| 5,006,208 | A | | 4/1991 | Kuhn et al. | |
| 5,085,744 | A | | 2/1992 | Brasch | |
| 5,169,514 | A | | 12/1992 | Hendriks et al. | |
| 5,244,593 | A | | 9/1993 | Roselle et al. | |
| 5,256,275 | A | * | 10/1993 | Brasch | 205/247 |
| 5,340,529 | A | | 8/1994 | DeWitt et al. | |
| 6,165,342 | A | | 12/2000 | Kuhn et al. | |
| 6,576,114 | B1 | | 6/2003 | Gioria | |
| 6,814,850 | B1 | * | 11/2004 | Manz et al. | 205/247 |
| 2004/0079449 | A1 | | 4/2004 | Kanekiyo et al. | |
| 2004/0195107 | A1 | * | 10/2004 | Chalumeau et al. | 205/247 |
| 2006/0011471 | A1 | | 1/2006 | Grippo | |
| 2006/0254924 | A1 | | 11/2006 | Ichihara et al. | |
| 2006/0283714 | A1 | * | 12/2006 | Egli et al. | 205/242 |

FOREIGN PATENT DOCUMENTS

| | | | |
|---|---|---|---|
| CH | 390 024 | | 7/1965 |
| CH | 445 434 | A | 7/1968 |
| CH | 555 412 | | 10/1974 |
| CH | 680927 | A5 | 12/1992 |
| CH | 682823 | A5 | 11/1993 |
| DE | 1 696 087 | A | 1/1972 |
| DE | 2829979 | C3 | 6/1990 |
| EP | 0 193 848 | A1 | 2/1986 |
| EP | 0 384 679 | A | 8/1990 |
| EP | 0 416 342 | A1 | 3/1991 |
| EP | 0 480 876 | A2 | 4/1992 |
| EP | 0 566 054 | A1 | 10/1993 |
| EP | 1 728 898 | A2 | 12/2006 |
| FR | 2 405 312 | A | 5/1979 |
| GB | 1134615 | A | 11/1968 |
| GB | 1156186 | A | 6/1969 |
| GB | 1 294 601 | A | 11/1972 |
| GB | 1 400 492 | | 7/1975 |

(Continued)

OTHER PUBLICATIONS

Green et al., "A Novel Process for Low-Carat Gold Electroplating Without Cadmium", Oberflaeche-Surface (no month, 1990), vol. 31, No. 10, pp. 11-13.*

Vianco, P. et al., "Interface reactions between 50In—50Pb solder and electroplated Au layers", Materials Science and Engineering A 409, 179-194, 2005.

Sukhanov, V. D. et al., "Features of the Domain Structure of $Cu_3Au$—In(Al) Alloys in Thin Films", UDC 669.21'3: 620.187.3, p. 1-8. 1994.

(Continued)

*Primary Examiner* — Edna Wong

(74) *Attorney, Agent, or Firm* — Oblon, McClelland, Maier & Neustadt, L.L.P.

(57) ABSTRACT

The invention relates to an electrolytic deposition in the form of a gold alloy with a thickness of between 1 and 800 microns and which includes copper. According to the invention, the deposition includes indium as the third main compound. The invention concerns the field of electroplating methods.

22 Claims, No Drawings

(56) References Cited

FOREIGN PATENT DOCUMENTS

| | | | | | |
|---|---|---|---|---|---|
| IN | 2005CH01186 | A | * | 7/2007 | ..... C25D 1/00 |
| JP | 62-164890 | A | | 7/1987 | |
| JP | 01-247540 | A | | 10/1989 | |
| JP | 2005-214903 | A | | 8/2005 | |
| WO | 97/17482 | A1 | | 5/1997 | |
| WO | 2009/037180 | A1 | | 3/2009 | |

OTHER PUBLICATIONS

Shashkov, O. D. et al., "Precipitant Phase Initiation on Periodic Antiphase Domain Boundaries", Metal Physics and Metal Science, vol. 41 No. 6, p. 1-12, UDX 539.4: 548.313.3. 1975.

"Colours of gold alloys—Definition, range of colours and designation", International Organization for Standardization, First Edition, 1987.

CAPLUS abstract (Aug. 7, 2007) corresponding to Indian Patent Application No. 1186/CHE/2005, labeled as "Exhibit A".

Document obtained from Molecular Connections Pvt., Ltd. (2012), which Applicants reasonably believe is the text from Indian Patent Application No. 1186/CHE/2005, labeled as "Exhibit B".

"Gold and Gold Alloys," at http://www.keytometals.com/Print.aspx?id=CheckArticle&site=ktn&LN=EN&NM=230 (Nov. 2009).

Paul A. Kohl, Electrodeposition of Gold, Modern Electroplating 115-130 (Mordechay Schlesinger and Milan Paunovie, eds., 5th ed. 2010).

C.Y. Ho et al., Electrical Resistivity of Ten Selected Binary Alloy Systems, 12 J. Phys. Chem. Ref. Data 183-322 (1983).

Machine translation of WO2009/037180 A1, Dec. 21, 2012, pp. 1-4 (illegible copy received from USPTO) and legible copy of the same produced Jul. 11, 2013, pp. 1-5.

European Search Report issued in corresponding application No. EP09173198, completed Mar. 29, 2010.

Database WPI Thomson Scientific, London, GB; AN 1987-240265 XP002574602 & JP 62 164890 A (Seiko Instr & Electronics Jul. 21, 1987 (Jul. 21, 1987).

Weisberg, Alfred, Gold Plating; Metal Finishing, Elsevier Science and Technology, Jan. 2000, vol. 98, Issue 1.

Machine translation of EP 0480876, downloaded Jun. 13, 2011.

Espacenet—Biblographic data corresponding to EP 0 480 876 A2, last updated Mar. 13, 2013, filed as "Exhibit A" in a co-pending related application.

"Casting and Solidification Process" (Jan. 9, 2010), available at http://www.scribd.com/doc/82888156/5-Solidification-Lab.pdf (last visited Jul. 2, 2013).

"Gold Education, Gold Karat Chart, Care of Gold Jewelry," at http://www.netcarats.com/eductation/gold-education.html (downloaded Jul. 4, 2013).

"Finishing Techniques in Metalwork," at http://www.philamuseum.org/booklets/&_42_74_1.html (2013)(downloaded Jul. 6, 2013).

"Carats v. Karats," at http://dendritics.com/scales/carat-def.asp (2013)(downloaded Jul. 5, 2013).

Peter Krauth, "Seven Ways to Tell if Your Gold is Counterfeit," at http://moneymorning.com/2013/01/02/seven-ways-to-tell-if-your-gold-is-counterfeit/ (Jan. 2, 2013).

Anselm T. Kuhn & Leslie V. Lewis, The Electroforming of Gold and Its Alloys, 21 Gold Bulletin 17, 17 (1988, issue 1), available at http://link.springer.com/article/10.1007/BF03214663.

Colours of Gold Alloys—Definition, Range of Colours and Designation, ISO 8654 (1st ed., Aug. 15, 1987).

Office Action issued in co-pending related U.S. Appl. No. 12/905,788 dated Dec. 10, 2013.

Office Action issued in co-pending related U.S. Appl. No. 14/244,071 dated Jul. 16, 2015.

Office Action issued in co-pending related U.S. Appl. No. 14/244,071 dated Oct. 28, 2015.

* cited by examiner

METHOD OF OBTAINING A YELLOW GOLD ALLOY DEPOSITION BY GALVANOPLASTY WITHOUT USING TOXIC METALS OR METALLOIDS

CROSS REFERENCE TO RELATED APPLICATIONS

This is a National Phase Application in the United States of International Patent Application PCT/EP 2008/062042 filed Sep. 11, 2008, which claims priority on Swiss Patent Application No. 01494/07 of Sep. 21, 2007. The entire disclosures of the above patent applications are hereby incorporated by reference.

FIELD OF THE INVENTION

The invention relates to an electrolytic deposition in the form of a thick gold alloy layer and the manufacturing method thereof.

BACKGROUND OF THE INVENTION

In the field of decorative plating, methods are known for producing gold electrolytic depositions that are yellow with a fineness greater than or equal to 9 carats, ductile with a thickness of 10 microns, and with a high level of tarnish resistance. These depositions are obtained by electrolysis in an alkaline galvanic bath containing 0.1 to 3 g/l of cadmium, in addition to gold and copper. The depositions obtained via these known methods have however cadmium levels of between 1 and 10%. Cadmium facilitates the deposition of thick layers, i.e. between 1 and 800 microns and provides a yellow alloy by reducing the quantity of copper contained in the alloy, however, cadmium is extremely toxic and prohibited in some countries.

Other known yellow depositions are alloys comprising gold and silver.

18 carat gold alloys containing copper and zinc and no cadmium are also known. However, these depositions are too pink (fineness too copper rich). Finally, these depositions have poor resistance to corrosion which means that they tarnish quickly.

SUMMARY OF THE INVENTION

It is an object of this invention to overcome all or part of the aforementioned drawbacks by proposing a method for depositing a thick gold alloy layer that is yellow and has neither zinc nor cadmium as main components.

The invention thus relates to an electrolytic deposition in the form of a gold alloy, whose thickness is comprised between 1 and 800 microns and includes copper, characterized in that it includes indium as the third main component.

According to other advantageous features of the invention:

- the deposition is substantially free of toxic metals or metalloids;
- the deposition includes a colour comprised within the fields of 1N and 3N (in accordance with ISO standard 8654);
- the deposition is shiny and is highly resistant to corrosion.

The invention also relates to a method for the galvanoplasty deposition of a gold alloy on an electrode dipped in a bath including gold metal in the form of aurocyanide alkaline, organometallic components, a wetting agent, a complexing agent and free cyanide, characterized in that the alloy metals are copper in the form of the copper II cyanide and potassium, and indium in complex aminocarboxylic or aminophosphoric form for depositing a shiny reflective yellow type gold alloy.

According to other advantageous features of the invention:

- the bath includes from 1 to 10 $g \cdot l^{-1}$ of gold metal in the form of alkaline aurocyanide and preferably 5 $g \cdot l^{-1}$;
- the bath includes from 30 to 80 $g \cdot l^{-1}$ of alkaline copper II cyanide and preferably 50 $g \cdot l^{-1}$;
- the bath includes from 10 $mg \cdot l^{-1}$ to 5 $g \cdot l^{-1}$ of indium metal in complex form and preferably includes 1 $g \cdot l^{-1}$;
- the bath includes 15 to 35 $g \cdot l^{-1}$ of free cyanide;
- the wetting agent includes a concentration of between 0.05 to 10 $ml \cdot l^{-1}$ and preferably 3 $ml \cdot l^{-1}$;
- the wetting agent is selected from among polyoxyalkylenic, ether phosphate, lauryl sulphate, dimethyldodecylamine-N-oxide, dimethyldodecyl ammonium propane sulfonate types or any other type able to wet in an alkaline cyanide medium;
- the aminocarboxylic complexing agent includes a concentration of between 0.1 and 20 $g \cdot l^{-1}$;
- the bath includes an amine in a concentration of between 0.01 and 5 $ml \cdot l^{-1}$
- the bath includes a depolariser in a concentration of between 0.1 $mg \cdot l^{-1}$ and 20 $mg \cdot l^{-1}$;
- the bath includes conductive salts of the following types: phosphates, carbonates, citrates, sulphates, tartrates, gluconates and/or phosphonates;
- the temperature of the bath is maintained between 50 and 80° C.;
- the pH of the bath is maintained between 8 and 12;
- the method is carried out at current densities of between 0.2 and 1.5 $A \cdot dm^{-2}$.

The electrolysis is preferably followed by a thermal treatment at least 450 degrees Celsius for at least 30 minutes in order to obtain optimum deposition quality.

The bath may also contain a brightener. The brightener is preferably a butynediol derivative, a pyridinio-propane sulfonate or a mixture of the two, a tin salt, sulfonated castor oil, methylimidazole, dithiocarboxylic acid, such as thiourea, thiobarbituric acid, imidazolidinthione or thiomalic acid.

In particular, in accordance with a non-limiting illustrative embodiment of the present invention, a method for galvanoplasty deposition of a gold alloy on an electrode dipped in a bath including gold metal in the form of alkaline aurocyanide, organometallic components, a wetting agent, a complexing agent and free cyanide is provided, wherein the method is characterized in that the alloy metals are copper in the form of copper II cyanide and potassium, and complex indium for depositing a shiny reflective yellow type gold alloy on the electrode. In accordance with a second non-limiting illustrative embodiment of the present invention, the first non-limiting embodiment is modified so that the complex indium is of the aminocarboxylic or aminophosphonic type. In accordance with a third non-limiting illustrative embodiment of the present invention, the first and second non-limiting embodiments are further modified so that the bath includes from 1 to 10 $g \cdot l^{-1}$ of gold metal in the form of alkaline aurocyanide.

In accordance with a fourth non-limiting illustrative embodiment of the present invention, the first, second, and third non-limiting embodiments are further modified so that the bath includes from 30 to 80 $g \cdot l^{-1}$ of copper II metal in the form of alkaline cyanide. In accordance with a fifth non-limiting illustrative embodiment of the present invention, the first, second, third, and fourth non-limiting embodiments are further modified so that the bath includes from 10 $mg \cdot l^{-1}$ to 5 $g \cdot l^{-1}$ of complex indium metal. In accordance with a sixth non-limiting illustrative embodiment of the present invention, the first, second, third, fourth and fifth non-limiting embodiments are modified so that the bath includes from 15 to 35 $g \cdot l^{-1}$ of free cyanide. In accordance with a seventh non-limiting illustrative embodiment of the present invention, the first, second, third, fourth, fifth and sixth non-limiting embodiments are further modified so that the wetting agent includes a concentration of between 0.05 and 10 $ml \cdot l^{-1}$.

In accordance with an eighth non-limiting illustrative embodiment of the present invention, the first or seventh non-limiting embodiments are further modified so that the wetting agent is chosen from among the following types: polyoxyalkylenic, ether phosphate, lauryl sulphate, dimethyldodecylamine N oxide, and dimethyldodecyl ammonium propane sulfonate. In accordance with a ninth non-limiting illustrative embodiment of the present invention, the first, second, third, fourth, fifth, sixth, seventh and eighth non-limiting embodiments are further modified so that the bath includes an amine concentration of between 0.01 to 5 $ml \cdot l^{-1}$. In accordance with a tenth non-limiting illustrative embodiment of the present invention, the first, second, third, fourth, fifth, sixth, seventh, eighth and ninth non-limiting embodiments are further modified so that the bath includes an amine concentration of between 0.01 $mg \cdot l^{-1}$ to 20 $mg \cdot l^{-1}$. In accordance with an eleventh non-limiting illustrative embodiment of the present invention, the first, second, third, fourth, fifth, sixth, seventh, eighth, ninth and tenth non-limiting embodiments are further modified so that the bath includes a depolarising concentration of between 0.1 $mg \cdot l^{-1}$ to 20 $mg \cdot l^{-1}$. In accordance with a twelfth non-limiting illustrative embodiment of the present invention, the first, second, third, fourth, fifth, sixth, seventh, eighth, ninth, tenth and eleventh non-limiting embodiments are further modified so that the bath includes conductive salts of the following types: phosphates, carbonates, citrates, sulphates, tartrates, gluconates and/or phosphonates.

In accordance with a thirteenth non-limiting illustrative embodiment of the present invention, the first, second, third, fourth, fifth, sixth, seventh, eighth, ninth, tenth, eleventh and twelfth non-limiting embodiments are further modified so that the temperature of the bath is maintained between 50° C. and 80° C. In accordance with a fourteenth non-limiting illustrative embodiment of the present invention, the first, second, third, fourth, fifth, sixth, seventh, eighth, ninth, tenth, eleventh, twelfth and thirteenth non-limiting embodiments are further modified so that the pH of the bath is maintained between 8 and 12. In accordance with a fifteenth non-limiting illustrative embodiment of the present invention, the first, second, third, fourth, fifth, sixth, seventh, eighth, ninth, tenth, eleventh, twelfth, thirteenth and fourteenth non-limiting embodiments are further modified so that the method is performed with a current density of between 0.2 and 1.5 $A \cdot dm^{-2}$. In accordance with a sixteenth non-limiting illustrative embodiment of the present invention, an electrolytic deposition in the form of a gold alloy is provided, wherein the electrolytic deposition is obtained from a method according to the first, second, third, fourth, fifth, sixth, seventh, eighth, ninth, tenth, eleventh, twelfth, thirteenth, fourteenth and fifteenth non-limiting embodiments of the present invention, wherein the electrolytic deposition has a thickness of between 1 and 800 microns and the electrolytic deposition includes copper, wherein the electrolytic deposition is characterized by including indium as a third main compound for obtaining a shiny colour that is between the fields 1N and 3N.

DETAILED DESCRIPTION OF THE PREFERRED EMBODIMENTS

In an example deposition, there is a gold alloy, free of toxic metals or metalloids, in particular free of cadmium, with a 2N yellow colour, a thickness of 200 microns, excellent brilliance and highly wear and tarnish resistant.

This deposition is obtained by electrolysis in an electrolytic bath of the following type:

Example 1

Au: 3 $g \cdot l^{-1}$
Cu: 45 $g \cdot l^{-1}$
In: 0.1 $g \cdot l^{-1}$
KCN: 22 $g \cdot l^{-1}$
pH: 10.5
Temperature: 65° C.
Current density: 0.5 $A \cdot dm^{-2}$
Wetting agent: 0.05 $ml \cdot l^{-1}$ NN-Dimethyldodecyl N Oxide
Iminodiacetic: 20 $g \cdot l^{-1}$
Ethylenediamine: 0.5 $ml \cdot l^{-1}$
Potassium selenocyalate: 1 $mg \cdot l^{-1}$

Example 2

Au: 6 $g \cdot l^{-1}$
Cu: 60 $g \cdot l^{-1}$
In: 2 $g \cdot l^{-1}$
KCN: 30 $g \cdot l^{-1}$
NTA: 4 $g \cdot l^{-1}$
Ag: 10 $mg \cdot l^{-1}$
Diethylentriamine: 0.2 $ml \cdot l^{-1}$
Gallium, selenium or tellurium: 5 $mg \cdot l^{-1}$
Sodium hypophosphite: 0.1 $g \cdot l^{-1}$
Thiomalic acid: 50 $mg \cdot l^{-1}$
Current density: 0.5 $A \cdot dm^{-2}$
Temperature: 70° C.
pH: 10.5
Wetting agent: 2 $ml \cdot l^{-1}$ ether phosphate In these examples, the electrolytic bath is contained in a polypropylene or PVC bath holder with heat insulation. The bath is heated using quartz, PTFE, porcelain or stabilised stainless steel thermo-plungers. Proper cathodic agitation and electrolyte flow must be maintained. The anodes are made of platinum plated titanium, stainless steel, ruthenium, iridium or alloys thereof.

Under such conditions, cathodic efficiency of 62 $mg \cdot A \cdot min^{-1}$ can be obtained, with a deposition speed of 1 μm in 3 minutes in example 1 and, in example 2, a shiny deposition of 10 μm in 30 minutes.

Of course, this invention is not limited to the illustrated example, but is capable of various variants and alterations, which will be clear to those skilled in the art. In particular, the bath may contain negligible quantities of the following metals: Ag, Cd, Zr, Se, Te, Sb, Sn, Ga, As, Sr, Be, Bi. Moreover, the wetting agent may be of any type able to wet in an alkaline cyanide medium.

Most generally, the invention concerns the field of electroplating methods, and relates to an electrolytic deposition in the form of a gold alloy with a thickness of between 1 and 800 microns and that includes copper. According to the invention, the deposition includes indium as a third main compound.

The invention claimed is:

1. A method for depositing a yellow gold alloy, wherein the method comprises the steps of:

(a) forming a bath including:

i. gold metal in a form of an alkaline aurocyanide;

ii. organometallic components;

iii. a wetting agent;

iv. a complexing agent and free cyanide;

v. copper metal in a form of a copper cyanide and potassium; and vi. indium metal in a form of a complex indium metal, (b) dipping an electrode to be coated in the bath; and (c) depositing by galvanoplasty a shiny reflective yellow gold alloy on the electrode, wherein the yellow gold alloy comprises gold, copper and indium as main components, wherein the bath does not contain zinc nor cadmium.

2. The method according to claim 1, wherein the complex indium metal is formed with an aminocarboxylic group and the indium metal or with an aminophosphonic group and the indium metal, wherein the amount of copper metal is from 30 to 80 $g \cdot l^{-1}$.

3. The method according to claim 2, wherein the bath includes the aminocarboxylic group in complex, in a concentration of between 0.1 $g \cdot l^{-1}$ to 20 $g \cdot l^{-1}$.

4. The method according to claim 1, wherein the bath includes from 1 to 10 $g \cdot l^{-1}$ of the gold metal.

5. The method according to claim 1, wherein the bath includes from 30 to 80 $g \cdot l^{-1}$ of the copper metal.

6. The method according to claim 1, wherein the bath includes from 10 $mg \cdot l^{-1}$ to 5 $g \cdot l^{-1}$ of the indium metal.

7. The method according to claim 1, wherein the bath includes from 15 to 35 $g \cdot l^{-1}$ of free cyanide.

8. The method according to claim 1, wherein a concentration of the wetting agent is between 0.05 and 10 $ml \cdot l^{-1}$.

9. The method according to claim 1, wherein the wetting agent is selected from the group consisting of polyoxyalkylenic, ether phosphate, lauryl sulphate, dimethyldodecylamine N oxide and dimethyldodecyl ammonium propane sulfonate.

10. The method according to claim 1, wherein the bath further includes an amine in a concentration of between 0.01 and 5 $ml \cdot l^{-1}$.

11. The method according to claim 1, wherein the bath further includes a depolarising agent in a concentration of between 0.1 $mg \cdot l^{-1}$ to 20 $mg \cdot l^{-1}$.

12. The method according to claim 1, wherein the bath further includes conductive salts selected from the group consisting of phosphates, carbonates, citrates, sulphates, tartrates, gluconates and phosphonates.

13. The method according to claim 1, wherein the temperature of the bath is maintained between 50° C. and 80° C.

14. The method according to claim 1, wherein the pH of the bath is maintained between 8 and 12.

15. The method according to claim 1, wherein the method is performed with a current density of between 0.2 $A \cdot dm^{-1}$ and 1.5 $A \cdot dm^{-2}$.

16. The method according to claim 1, wherein the complexing agent is an aminocarboxylic complexing agent.

17. The method according to claim 1, wherein a thickness of the shiny reflective yellow gold alloy on the electrode is between 1 and 800 microns and has a shiny colour that is between fields 1N and 3N.

18. A method for depositing a yellow gold alloy, wherein the method comprises the steps of:

(a) forming a bath including:

i. gold metal in a form of an alkaline aurocyanide;

ii. organometallic components;

iii. a wetting agent;

iv. a complexing agent and free cyanide;

v. copper metal in a form of a copper cyanide and potassium;

vi. indium metal in a form of a complex indium metal; and vii. no more than negligible quantities of silver, zinc, and cadmium;

(b) dipping an electrode to be coated in the bath; and (c) depositing by galvanoplasty a shiny reflective yellow gold alloy on the electrode, wherein the yellow gold alloy comprises gold, copper and indium as main components, wherein the bath does not contain zinc nor cadmium.

19. The method according to claim 18, wherein the bath includes no more than negligible quantities of metals selected from the group consisting of Se, Te, Sb, Sn, Ga, As, Sr, Be and Bi.

20. The method according to claim 18, wherein the complexing agent is an aminocarboxylic complexing agent.

21. The method according to claim 18, wherein the bath does not contain arsenic.

22. A method for depositing a yellow gold alloy, wherein the method comprises the steps of:

(a) forming a bath consisting essentially of:

i. gold metal in a form of an alkaline aurocyanide;

ii. organometallic components;

iii. a wetting agent;

iv. a complexing agent and free cyanide;

v. copper metal in a form of a copper cyanide and potassium; and vi. indium metal in a form of a complex indium metal, (b) dipping an electrode to be coated in the bath; and (c) depositing by galvanoplasty a shiny reflective yellow gold alloy on the electrode, wherein the yellow gold alloy comprises gold, copper and indium as main components, wherein the bath does not contain zinc nor cadmium.

* * * * *